US010226873B2

(12) United States Patent
Phoon et al.

(10) Patent No.: US 10,226,873 B2
(45) **Date of Patent: *Mar. 12, 2019**

(54) HAIR CUTTING APPLIANCE, RECEPTACLE AND CONNECTOR PLUG

(71) Applicant: KONINKLIJKE PHILIPS N.V., Eindhoven (NL)

(72) Inventors: Kin Fatt Phoon, Eindhoven (NL); Erwin Werps, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/674,580

(22) Filed: Aug. 11, 2017

(65) Prior Publication Data

US 2017/0341246 A1 Nov. 30, 2017

Related U.S. Application Data

(63) Continuation of application No. 15/028,444, filed as application No. PCT/EP2014/073563 on Nov. 3, 2014, now Pat. No. 9,731,425.

(30) Foreign Application Priority Data

Nov. 22, 2013 (EP) ..... 13193967

(51) Int. Cl.
*H01R 13/10* (2006.01)
*B26B 19/38* (2006.01)
*B26B 21/52* (2006.01)

(52) U.S. Cl.
CPC ..... *B26B 19/386* (2013.01); *B26B 19/3873* (2013.01); *B26B 21/521* (2013.01)

(58) Field of Classification Search
CPC .... H01R 23/10; H01R 2103/00; H01R 24/66; H01R 29/00; B25F 5/02; B26B 19/00; B26B 19/04
(Continued)

(56) References Cited

U.S. PATENT DOCUMENTS 2,172,086 A * 9/1939 Marszalski ..... H01R 33/05 279/23.1
2,264,033 A * 11/1941 Youhouse ..... B26B 19/28 173/217
(Continued)

FOREIGN PATENT DOCUMENTS

BE 1000779 A7 4/1989
EP 1938931 A2 7/2008
(Continued)

*Primary Examiner* — Abdullah A Riyami
*Assistant Examiner* — Vladimir Imas

(57) ABSTRACT

A hair cutting appliance includes a receiving receptacle for receiving a connector plug to detachably connect a cutting unit to a housing of the hair cutting appliance. The receiving receptacle includes a receiving socket having a receiving recess adapted to receive an engagement element of the connector plug, and a biasing unit arranged in the receiving socket underneath the receiving recess. The biasing unit includes first and second biasing elements laterally spaced with respect to each other and arranged to receive the engagement element of the connector plug. The first biasing element includes a retaining contact portion configured to define the receiving position of the engagement element in an insertion direction (Z). The second biasing element includes an alignment contact portion configured to define the receiving position of the engagement element in a longitudinal direction (X) and in a lateral direction (Y).

20 Claims, 6 Drawing Sheets

(58) Field of Classification Search
USPC ..... 439/568, 848, 682, 856, 506; 30/43, 30/43.4, 43.5, 43.6, 201
See application file for complete search history.

(56) References Cited

U.S. PATENT DOCUMENTS 2,323,148 A * 6/1943 McLaughlin ..... H01J 29/925 174/50.53
2,445,530 A * 7/1948 Majer ..... B26B 19/205 30/201
2,916,820 A * 12/1959 Clark ..... B26B 19/20 30/201
3,171,183 A * 3/1965 Johnston ..... A01K 27/005 24/635
3,172,200 A 3/1965 Ream
3,290,775 A * 12/1966 Tolmie ..... B26B 19/42 30/34.2
3,791,030 A * 2/1974 Jackson ..... B26B 19/265 30/43.9
3,810,305 A 5/1974 Perry
3,811,188 A * 5/1974 Brenneman ..... B26B 19/02 30/34.05
4,274,199 A * 6/1981 Gallanis ..... B26B 19/10 30/34.1
4,743,205 A * 5/1988 Mitani ..... H01R 24/50 439/63
4,797,998 A 1/1989 Motta
5,014,428 A * 5/1991 Yamashita ..... B26B 19/16 30/43
5,025,121 A * 6/1991 Allen ..... H01H 1/38 200/254
5,201,781 A * 4/1993 Jestadt ..... B26B 19/048 30/43.91
5,367,772 A * 11/1994 Ogawa ..... B26B 19/205 30/201
5,678,312 A * 10/1997 Watanabe ..... B26B 19/28 30/43.92
5,735,716 A * 4/1998 Bilezikjian ..... H01R 13/187 439/843
5,745,995 A * 5/1998 Yamashita ..... B26B 19/048 30/43.6
5,823,812 A * 10/1998 Bhargava ..... H01R 13/6278 439/345
6,079,103 A * 6/2000 Melton ..... B26B 19/20 30/43.92
6,190,184 B1 * 2/2001 Cimbal ..... B26B 19/382 439/131
6,257,925 B1 * 7/2001 Jones ..... H01R 13/6273 439/357
6,505,404 B2 * 1/2003 Ullmann ..... B26B 19/063 30/216
6,536,116 B2 * 3/2003 Fung ..... B26B 19/063 30/199
6,742,262 B2 * 6/2004 Rizzuto, Jr. ..... B26B 19/205 30/201
6,836,965 B1 * 1/2005 Ross ..... B26B 19/148 30/29.5
7,202,446 B2 * 4/2007 Shalev ..... A45D 26/0009 219/222
7,234,242 B2 * 6/2007 Yao ..... B26B 19/06 30/201
7,306,483 B2 * 12/2007 Phillips ..... H01R 11/11 439/568
7,346,990 B2 * 3/2008 Dirks ..... B26B 19/06 30/210
7,748,123 B2 * 7/2010 Bednar ..... B26B 19/02 30/210
8,141,253 B2 * 3/2012 Royle ..... B26B 19/06 30/34.05
8,319,152 B2 * 11/2012 Shalev ..... B26B 19/00 219/221
8,389,906 B2 * 3/2013 Azar ..... A45D 26/0009 132/118
8,585,445 B2 * 11/2013 Deehr ..... A61N 1/375 439/345
D708,143 S * 7/2014 Starke ..... D13/147
9,027,251 B2 * 5/2015 Schmitt ..... B26B 19/14 30/41
9,147,952 B2 * 9/2015 Kikuchi ..... H01R 12/7082
9,174,349 B2 * 11/2015 Schmitt ..... B26B 19/14
9,242,385 B2 * 1/2016 Erickson ..... B26B 19/3846
9,266,245 B2 * 2/2016 Kammer ..... B26B 19/386
9,427,879 B2 * 8/2016 Wevers ..... B26B 19/20
2002/0108252 A1 8/2002 Ferraro
2003/0088984 A1 5/2003 Brandt
2008/0295340 A1 * 12/2008 Carlucci ..... B26B 19/063 30/199
2008/0295534 A1 12/2008 Farrow
2012/0240414 A1 * 9/2012 Wevers ..... B26B 19/063 30/201
2013/0145626 A1 * 6/2013 Xu ..... B26B 21/4012 30/41
2014/0196292 A1 * 7/2014 Schmitt ..... B26B 19/14 30/41.6

FOREIGN PATENT DOCUMENTS

JP 2007222531 A 9/2007
WO 2010078564 A2 7/2010
WO 2012033362 A2 3/2012
WO 2013150412 A1 10/2013

* cited by examiner

HAIR CUTTING APPLIANCE, RECEPTACLE AND CONNECTOR PLUG

CROSS REFERENCE TO RELATED APPLICATION

This application is a continuation of prior U.S. patent application Ser. No. 15/028,444, filed Apr. 11, 2016, which is a national application of PCT Application No. PCT/EP2014/073563, filed Nov. 3, 2014 and claims the benefit of European Patent Application No. 13193967.0, filed Nov. 22, 2013, the entire contents of each of which are incorporated herein by reference thereto.

FIELD OF THE INVENTION

The present disclosure relates to a hair cutting appliance, particularly to an electrically operated hair cutting appliance, and more particularly to a detachable interface for a cutting unit for such an appliance. The detachable interface can be formed by a receiving receptacle and a corresponding connector plug, wherein at least one of the receiving receptacle and the connector plug can be provided at a housing of the hair cutting appliance, and wherein the other one thereof can be provided at the cutting unit.

BACKGROUND OF THE INVENTION

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both, shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Unfortunately, common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small circular perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that often prevents hair from being cut off close to the skin. Consequently, a user desiring to both shave and trim his body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles this issue by providing for a blade set comprising a stationary blade that houses the movable blade such that a first portion of the stationary blade is arranged at the side of the movable blade facing the skin when in use, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge including respective teeth alternating with slots also allows for longer hairs to enter the slots and, consequently, to be cut by the relative cutting motion between the movable blade and the stationary blade.

SUMMARY OF THE INVENTION

The hair cutting appliance disclosed in WO 2013/150412 A1 adequately addresses both shaving and trimming performance. Apart from that, the reference remains silent on practical use aspects. For instance, during use, wear may occur at the cutting unit of such a device. Furthermore, dirt and/or hair residues may be built up at the cutting unit.

It is an object of the present disclosure to provide for a hair cutting appliance, particularly for a receiving receptacle and a connector plug for a cutting unit thereof, that my exhibit an improved daily-use-suitability. Particularly, a receiving receptacle and a corresponding connector plug may be presented that may enable swift and simple attachment and detachment of the cutting unit with respect to a housing of the appliance. More preferably, it would be advantageous to provide for a receiving receptacle and a corresponding connector plug that may enable accurate mounting of the cutting unit at the housing (or main body) of the hair cutting appliance.

In a first aspect of the present disclosure a receiving receptacle for a connector plug for connecting a detachable cutting unit of a hair cutting appliance is presented, the receiving receptacle comprising at least one receiving socket comprising a receiving recess that is adapted to receive a respective engagement element of a connector plug, at least one biasing unit arranged in the at least one receiving socket underneath or, more generally associated with, the receiving recess, wherein the at least one biasing unit comprises a first biasing element and a second biasing element opposing the first biasing element, the first biasing element and the second biasing element being laterally spaced with respect to each other, the first biasing element and the second biasing element being arranged to receive the engagement element of the connector plug in a biasing manner, thereby defining the receiving position of the engagement element, wherein the first biasing element comprises a retaining contact portion that is configured to define the receiving position of the engagement element in an insertion direction Z, and wherein the second biasing element comprises an alignment contact portion that is configured to define the receiving position of the engagement element in a longitudinal direction X and in a lateral direction Y.

This aspect is based on the insight that achieving accurate narrow tolerances for detachable parts of a hair cutting appliance is often burdensome when relying on defined clearances and defined seats of basically rigid mating parts and components. In other words, adequate tolerances have to be chosen such that on the one hand the components are still connectable in the desired manner. On the other hand, it is required that the fit is not too loose since in this way the mounted components may be fitted in a loose, rattling manner and therefore be regarded as inferior parts exhibiting poor quality. Furthermore, mating components that are subjected to large tolerances might adversely affect the operating performance of the hair cutting appliance. It is therefore proposed in accordance with the first aspect of the present disclosure to rely, at least partially, on force-fit mating in at least two of three (spatial) directions. Consequently, the connector plug can be received in the receiving receptacle in a basically free-off-play manner. This is beneficial since in this way "zero-tolerances" or, at least, "close-to-zero-tolerances" can be achieved. High repetitive accuracy is enabled such that replacement cutting units can be attached to the hair cutting appliance so as to regain cutting performance, if necessary. This can be achieved, thanks to the at least one biasing unit, without the need of considerably narrow dimensional tolerances at the mating components.

It is worth to be mentioned in this regard that the above aspect does not necessarily exclude the first biasing element from any contribution to the arrangement in the X direction and the Y direction, and that the second biasing element is not necessarily excluded from any contribution to the arrangement in the Z direction. It is, however, preferred that positioning the engagement element is primarily a distributed task, wherein the first biasing element dominates Z positioning, and wherein the second biasing element dominates X positioning and Y positioning. This may be beneficial, since in this way the second biasing element may be designed so as to generate a considerably high positioning force (in the X direction and the Y direction) that does not significantly influence the release force for the engagement element. The second biasing element may, if at all, generate minor frictional force components that may influence the release force. The first biasing element, on the contrary, basically engages a respective counterpart at the engagement element and may therefore generate a significantly larger retaining force (in the Z direction). Assuming that one would then attempt to increase the positioning force by increasing the stiffness of the first biasing element, also the retaining force would become significantly greater which might be experienced by the user as being unpleasant since actuating the interface might become more difficult and effortful.

For the purpose of this disclosure, the lateral direction Y may be regarded as a direction that is basically parallel to a main extension of a cutting edge of the cutting unit. Similarly, the longitudinal direction may be regarded as a direction that is perpendicular to the lateral direction Y. In other words, the lateral direction Y may be regarded as a direction that is basically perpendicular to a presumed (or an imaginary) moving direction of the hair cutting appliance when cutting hair. The insertion direction Z, as used herein, may be regarded as the direction that is perpendicular to the longitudinal direction X and perpendicular to the lateral direction Y. Furthermore, the insertion direction Z may be regarded as a direction that is basically parallel to a path defined by an insertion or release motion of the mating components of the hair cutting appliance. It should be understood that the above definitions are merely provided for illustrative purposes, and shall not be construed in a limiting way. It should be further mentioned that in accordance with the first aspect of the disclosure a receiving receptacle may be provided that comprises at least one biasing unit having a first biasing element and a second biasing element that are configured and cooperate so as to define a spatial receiving position of a corresponding engagement element of a connector plug. As used herein, spatial position refers to a position in a three-dimensional space. The skilled person may therefore readily understand that the above-introduced longitudinal direction X, lateral direction Y and insertion direction Z do not necessarily have to perfectly match a coordinate system having respective X-, Y-, and Z-axes of a cutting unit or a hair cutting appliance as such. It should be therefore understood that those skilled in the art may readily convert and/or transfer the exemplary directions provided herein when being confronted with alternative embodiments, respective figures and illustrations including different orientations.

It is particularly preferred that the at least one engagement element of the connector plug is at least partially received in a force-fit manner at the receiving receptacle in each of the longitudinal direction X, the lateral direction Y, and the insertion direction Z. Consequently, the connector plug can be received without significant play.

It is worth noting in this connection that the definition of the receiving position of the engagement element by the first biasing element and the second biasing element does not necessarily have to involve a "floating" mounting merely defined by biasing forces of the first biasing element and the second biasing element. By contrast, in at least one of the longitudinal direction X, the lateral direction Y, and the insertion direction Z, the receiving position of the engagement element may be defined through a cooperation of the first biasing element or the second biasing element and a corresponding abutment (or stop) element provided at the receiving receptacle and/or the connector plug. In other words, at least the first biasing element or the second biasing element may urge (or push) the at lest one engagement element into a defined abutment position with respect to the receiving receptacle. Design-dependent and/or production-dependent tolerances may be reduced or, more preferably, eliminated in this way.

In some embodiments, the at least one biasing unit comprises at least one flat spring element. In some embodiments, the at least one flat spring element may be regarded as a leaf spring element. At least one of or both the biasing element and the second biasing element may be configured as flat spring element.

In alternative embodiments, the at least one biasing unit may comprise at least one wire spring element. At least one or both of the first biasing element and the second biasing element may be configured as a wire spring element. Generally, the first biasing element and the second biasing element may be integrally formed. However, in some embodiments, the first biasing element and the second biasing element may be formed as separate parts. Generally, at least one of the first biasing element and the second biasing element may be formed as a metal spring element. Alternatively, at least one of the first biasing element and the second biasing element may be formed as a plastic spring element.

In another embodiment in accordance with the first aspect of the disclosure, the retaining contact portion of the first biasing element comprises a bent section that is adapted to engage the engagement element, thereby defining the receiving position of the engagement element in the insertion direction Z. The bent section and the engagement element may be arranged so as to cooperate in a force-fit engagement manner to define and retain the receiving position in the insertion direction Z. It is particularly preferred in this regard that a retention force of the connector plug, when being mounted to the receiving receptacle, is substantially attributable to the biasing force of the first biasing element. In other words, for disengaging the connector plug and the receiving receptacle, a user has to exert a disengagement force that is basically sufficient to disengage the retaining contact portion of the first biasing element from the engagement element of the connector plug. It is particularly preferred that the bent section of the first biasing element is configured to engage a recess or a projection at the engagement element that may serve as a locking feature or, in other words, a form-fit feature to retain the position of the engagement element in the insertion direction.

According to still another embodiment the alignment contact portion of the second biasing element comprises opposite contact sections arranged at longitudinal ends thereof that define the receiving position of the engagement element in the longitudinal direction X. The opposite contact sections may be defined by end surfaces and/or by basically longitudinally spaced projections at the second biasing element, for instance. The second biasing element, particularly the alignment contact portion thereof, may engage the engagement element such that movement of the engagement element in the longitudinal direction X is prevented, wherein, at the same time, movement in the insertion direction Z of the engagement element is basically permitted by the second biasing element. It is worth mentioning in this regard that the second biasing element may urge or bias the engagement element which may generate friction that needs to be surmounted when removing the engagement element from the receiving receptacle. It is, however, preferred that the alignment contact portion of the second biasing element does not engage a recess or projection of the arrangement element that may serve as a form-lock feature thereof in the insertion direction.

It is further preferred in this regard that the first biasing element is arranged to urge the engagement element in the lateral direction Y, wherein the second biasing element is arranged to urge the engagement element in the lateral direction Y, and wherein the first biasing element and the second biasing element are urging towards each other, thereby defining the receiving position of the engagement element in the lateral direction Y.

Since the first biasing element and the second biasing element are arranged to act against each other, they are capable of receiving and retaining the engagement element therebetween. It is particular preferred in this regard that the first biasing element and second biasing element are basically aligned in the longitudinal direction X (that is basically perpendicular to the lateral direction Y). The position of the engagement element in the lateral direction Y may be defined in a floating manner since the first biasing element and the second biasing element may act against each other such that a state of equilibrium of the biasing forces may be achieved which may define a respective lateral position of the engagement element. However, in alternative embodiments, respective lateral abutment elements may be provided ensuring a defined lateral end position of the engagement element.

It is particularly preferred that the receiving receptacle comprises a first receiving recess and a second receiving recess that are adapted to receive a first engagement element and a second engagement element, the first receiving recess and the second receiving recess being laterally spaced with respect to each other, and a first biasing unit and a second biasing unit respectively arranged in a first receiving socket and a second receiving socket underneath, or, more generally associated with, the first receiving recess and the second receiving recess.

This embodiment is particularly beneficial since in this way the spatially-defining structure of the first biasing unit is basically doubled. As used herein, the doubled configuration may involve a mirror-inverted configuration, a copied configuration, etc. It may be further preferred that the first receiving recess is arranged in the vicinity of a first lateral end of the receiving receptacle, while the second receiving recess is arranged in the vicinity of a second lateral end of the receiving receptacle. By doubling the receiving recesses and the respective biasing units, the receiving receptacle can be adapted to receive a connector plug comprising two corresponding engagement elements. Consequently, aligning and retaining of the cutting unit at the housing of the hair cutting appliance can be even further improved since a corresponding higher number of mating components and contact elements is provided. A retention force for the cutting unit can be adequately adapted. Spacing the first receiving recess and the second receiving recess and the respective biasing units in at least one of the longitudinal direction X and the lateral direction Y further reduces mounting tolerances.

It is particular preferred in connection with this embodiment that the respective first biasing elements of the first biasing unit and the second biasing unit are integrally formed. It is further preferred, optionally or in the alternative, that the respective second biasing elements of the first biasing unit and the second biasing unit are integrally formed. In an alternative embodiment, the first biasing element and the second biasing element of a respective biasing unit may be integrally formed. In yet another embodiment, a biasing arrangement comprising the first and the second biasing unit is provided, comprising the first and the second biasing element of the first biasing unit and the first and the second biasing element of the second biasing unit, is integrally formed. In yet an alternative embodiment, each of the biasing elements is formed as a separate part.

According to yet another aspect of the present disclosure, a connector plug for a receiving receptacle for connecting a detachable cutting unit of a hair cutting appliance is presented, the connector plug comprising at least one engagement element extending from a base in an insertion direction Z, wherein the at least one engagement element comprises, viewed in a plane perpendicular to the insertion direction Z, a cross-sectional profile being adapted to fit through a receiving recess of a respective receiving receptacle, wherein the at least one engagement element comprises a contact indentation extending substantially parallel to the insertion direction Z, wherein the contact indentation is adapted to contact a biasing unit of the receiving receptacle to define the receiving position of the engagement element in a longitudinal direction X, wherein the at least one engagement element comprises an engagement recess portion that is adapted to contact a biasing unit of the receiving receptacle to define the receiving position of the engagement element in the insertion direction Z, and wherein the contact indentation and the engagement recess portion are arranged on opposite sides of the at least one engagement element.

This embodiment is based on the insight that the at least one engagement element may be formed and shaped such that defined form features may be provided that may be engaged by respective engaging biasing elements such that, upon mounting the connector plug, the position of the connector plug may be spatially defined in a desired and repetitive manner. The connector plug may be formed, for instance, as an injection-molded part. It is particularly preferred that the connector plug is provided at the cutting-unit side of the hair cutting appliance, whereas the receiving receptacle is provided at the housing side of the hair cutting appliance. This is beneficial since in this way the relatively cheap connector plug may be present at the replacement part, while the relatively costly receptacle arrangement can be provided at the housing of the hair cutting appliance which is typically not intended to be replaced during lifetime of the hair cutting appliance. The connector plug is particularly suited for mass production. Alignment and retaining of the connector plug is ensured through cooperation of the at least one engagement element of the connector plug and at least one respective biasing unit at the receiving receptacle. Consequently, even though being cost-efficiently manufacturable, the connector plug can be accurately mounted such that adequate cutting performance can be ensured also for replacement cutting units.

According to an embodiment of the connector plug, the contact indentation defines a concave surface at the at least one engagement element, wherein the contact indentation is arranged to embrace the second biasing element in the longitudinal direction X when being mounted to the receiving receptacle. By way of example, the at least one engagement element may comprise a cross-sectional profile that is shaped as a ring segment having a concave (inner) surface and a convex (outer) surface. Shaping the contact indentation as a concave surface may be beneficial since in this way the opposite contact sections of the second biasing element may also bias the contact indentation in the lateral direction, thereby defining the position of the contact indentation in both the lateral direction Y and the longitudinal direction X. In other words, the contact indentation may comprise at least one contact surface that is inclined with respect to the longitudinal direction X and the lateral direction Y and, preferably, basically parallel to the insertion direction.

According to yet another embodiment of the connector plug the cross-sectional profile of the at least one engagement element is substantially C-shaped or U-shaped. Also in this way the contact indentation having at least one concave surface or at least one inclined surface can be suitably formed. It is further preferred in some embodiments that the cross-sectional profile of the at least one engagement element is not mirror-inverted with respect to a central plane that is defined by the insertion direction Z and the lateral direction Y. Such an arrangement may contribute to the prevention of assembly faults. The cutting unit can then only be mounted in a desired orientation. Assembling with defined, accurate orientations can also be enhanced by engagement elements comprising cross-sectional profiles that are basically mirrored with respect to the central plane. This applies in particular when two respective engagement elements are provided at the connector plug having cross-sectional profiles that differ from each other.

According to still another embodiment of the connector plug the engagement recess portion comprises a laterally extending recess portion at the at least one engagement element. In other words, the engagement recess portion extends at least partially in a direction that is basically parallel to the lateral direction Y. By way of example, the laterally extending engagement recess portion may comprise an undercut section that may be engaged by the retaining contact portion of the first biasing element. However, in an alternative embodiment, the engagement recess portion may comprise an at least partially protruding section that may be engaged by the retaining contact portion of the first biasing element. The engagement recess portion may also be formed by a lateral aperture in the at least one engagement element.

It is particularly preferred that the connector plug comprises a first engagement element and a second engagement element, the first engagement element and the second engagement element being laterally spaced with respect to each other, the first engagement element and the second engagement element being respectively adapted to fit through a first receiving recess and a second receiving recess of the receiving receptacle, and to contact a first biasing unit and a second biasing unit when being mounted to the receiving receptacle.

This embodiment may involve a configuration permitting an inverted or laterally reversed mounting of the connector plug. Alternatively, this embodiment may involve a configuration preventing an inverted or laterally reversed mounting of the connector plug. Generally, the connector plug can be received at the receiving receptacle without significant assembly play. Rather, the connector plug may be biased by the at least one biasing unit in at least one of the longitudinal direction X, the lateral direction Y and the insertion direction Z. Preferably, the connector plug is biased against an abutment element in at least one of the longitudinal direction X, the lateral direction Y, and the insertion direction Z.

Another aspect of the present disclosure is directed to a hair cutting appliance comprising a housing accommodating a motor, and a detachable cutting unit, wherein the housing further comprises a receiving receptacle in accordance with the principles of the present disclosure, and wherein the detachable cutting unit comprises a connector plug in accordance with the principles of the present disclosure. Preferably, the receiving receptacle and the connector plug of the cutting unit are formed in accordance with at least some of the aspects and embodiments discussed herein.

These and other feature and advantages of the disclosure will be more fully understood from the following detailed description of certain embodiments of the disclosure, taken together with the accompanying drawings, which are meant to illustrate and not to limit the disclosure.

BRIEF DESCRIPTION OF THE DRAWINGS

Several aspects of the disclosure will be apparent from and elucidated with reference to the embodiments described hereinafter. In the following drawings

DETAILED DESCRIPTION OF THE INVENTION

Figure 1:
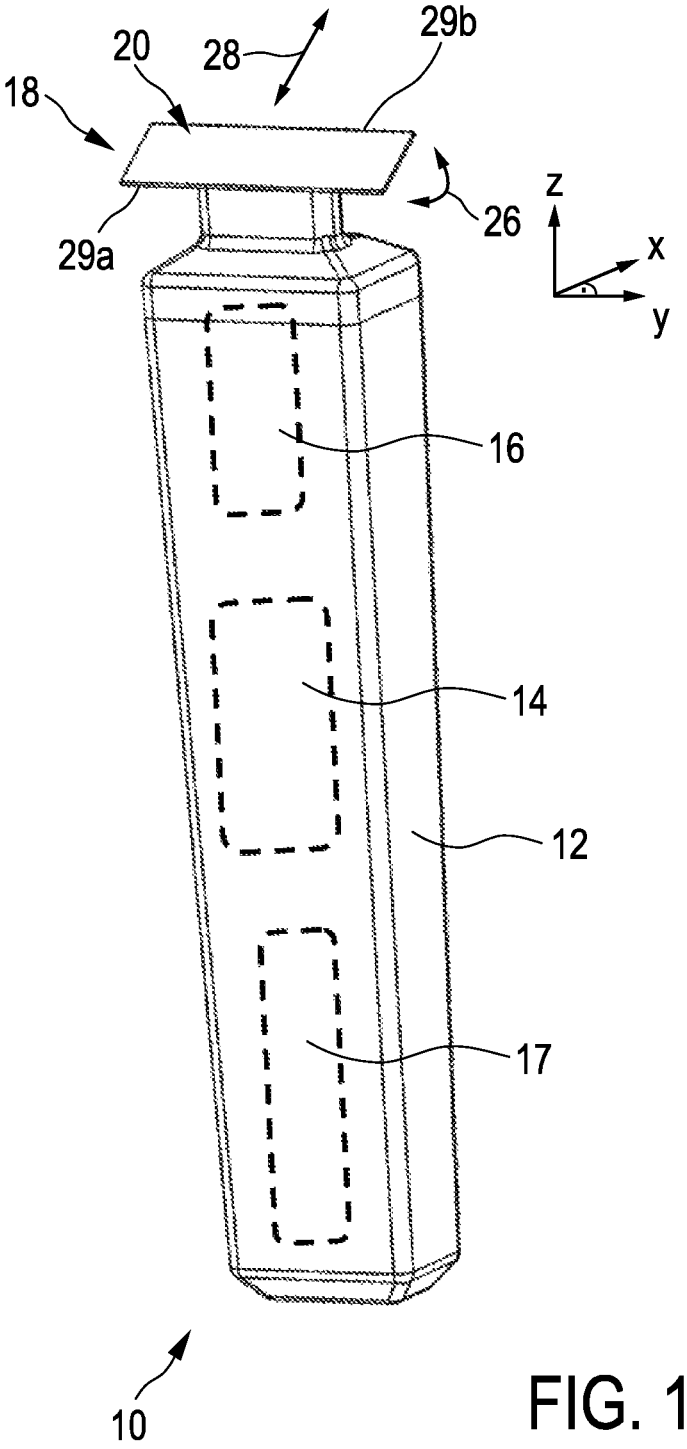
FIG. 1 shows a schematic perspective view of an exemplary electric hair cutting appliance fitted with an exemplary embodiment of a cutting unit that is releasably attachable to the hair cutting appliance for hair cutting operations.

FIG. 1 schematically illustrates, in a simplified perspective view, an exemplary embodiment of a hair cutting appliance 10, particularly an electric hair cutting appliance 10. The cutting appliance 10 may include a housing 12, a motor indicated by a dashed block 14 in the housing 12, and a drive mechanism indicated by a dashed block 16 in the housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be provided with a power cable for connecting a power supply. A power supply connector may be provided in addition or in the alternative to the (internal) electric battery 17.

The cutting appliance 10 may further comprise a cutting head or cutting unit 18. At the cutting unit 18, a blade set 20 may be attached to the hair cutting appliance 10. The blade set 20 of the cutting unit 18 may be driven by the motor 14 via the drive mechanism 16 to enable a cutting motion.

Figure 1A:
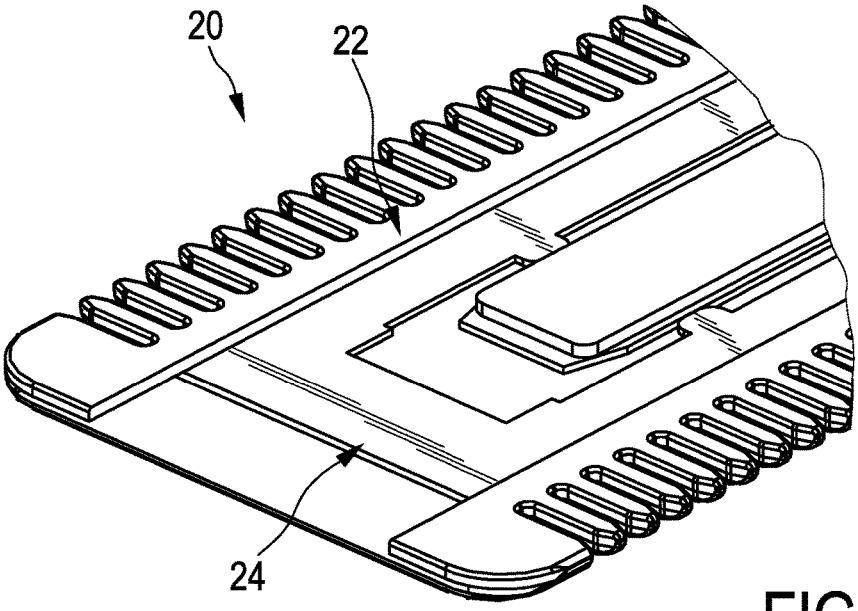
FIG. 1*a* is a partial perspective bottom view of a blade set of a cutting unit of a hair cutting appliance in accordance with FIG. 1.
Figure 1B:
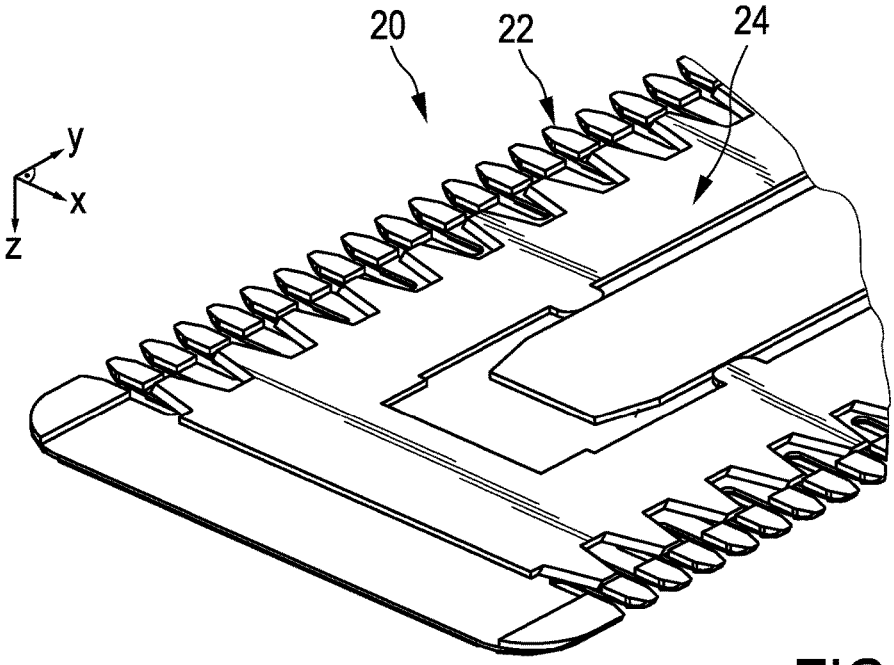
FIG. 1*b* is a further partial perspective top view corresponding to the view of FIG. 1*a*, a wall portion of the blade set being omitted primarily for illustrative purposes.

The cutting motion may be generally regarded as relative motion between a stationary blade 22 and a movable blade 24 of the blade set 20, see also FIGS. 1*a* and 1*b*. Generally, a user may grasp and guide the cutting appliance 10 through hair in a moving direction 28 to cut hair. Furthermore, the blade set 20 can be arranged at the cutting unit 18 in a pivoting manner, refer to the curved double-arrow indicated by reference numeral 26. In some embodiments, the cutting appliance 10, or, more specifically, the cutting unit 18 including the blade set 20, can be passed along skin to cut hair growing at the skin. When cutting hair closely to the skin, basically a shaving operation can be performed aiming at cutting (or chopping) at the level of the skin. However, also clipping (or trimming) operations may be envisaged, wherein the cutting unit 18 comprising a blade set blade set 20 is passed along a path at a desired distance relative to the skin.

When being guided or led through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference and having a fixed definition and relation with respect to the orientation of the cutting appliance 10 and its cutting unit 18 fitted with the blade set 20. That is, an overall orientation of the cutting appliance 10 with respect to the to-be-cut hair at the skin may be construed as somewhat unsteady. However, for illustrative purposes, it can be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several of FIGS. 1 to 11. By way of example, a Cartesian coordinate system X-Y-Z is indicated in FIG. 1. An X axis of the respective coordinate system extends in a generally longitudinal direction that is generally associated with length, for the purpose of this disclosure. A Y axis of the coordinate system extends in a lateral (or transverse) direction associated with width, for the purpose of this disclosure. A Z axis of the coordinate system extends in a height or insertion direction which may be referred to for illustrative purposes, at least in some embodiments, as a generally vertical direction. It goes without saying that an association of the coordinate system to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations.

FIGS. 1*a* and 1*b* illustrate a partial detailed view of the blade set 20 of the cutting unit 18 exemplarily shown in FIG. 1. The blade set 20 comprises a stationary blade 22 and a movable blade 24. By way of example, the blade set 20 may comprise at least one basically laterally extending edge or cutting edge. It is preferred that the blade set 20 comprises two cutting edges 29*a*, 29*b* that are longitudinally spaced apart from each other. The stationary blade 22 and the movable blade 24 may comprise a basically flat shape. It is particularly preferred that the stationary blade 22 is arranged to house and to guide the movable blade 24. In other words, the stationary blade 22 may be regarded as a shell or a cage for the movable blade 24. The stationary blade 22 may comprise a cross-section, viewed in the plane perpendicular to the lateral direction Y, that is, at the at least one cutting edge, basically U-shaped. The U-shaped form may comprise a first leg and a second leg. Between the first leg and the second leg a guiding slot for the movable blade 24 may be defined. The movable blade 24 can be housed and guided in the stationary blade 22 for lateral movement with respect to the stationary blade 22. The movable blade 24 and the stationary blade 22 may comprise respective teeth at their cutting edges that allow to cut hairs in a scissor-like action. The stationary blade 22 basically encloses the movable blade 24 at the side thereof facing the skin when cutting hair and, at least partially, at the side thereof facing away from the skin when cutting hair. The blade set 20, or, more specifically, the stationary blade 22 and the movable blade 24 thereof, may comprise a first toothed cutting edge and a second toothed cutting edge. The cutting edges are spaced from each other in the moving direction 28 that is basically parallel to the longitudinal direction X.

So as to suitably adapt the blade set 20 to shaving operations, it is preferred that a general height (or thickness) of the blade set 20, at least at the at least one cutting edge, is relatively small. Particularly, it is preferred that a skin-sided portion of the stationary blade 22 has a thickness that is relatively small. Even more preferably, the thickness of the stationary blade portion facing the skin is significantly smaller than the thickness of the stationary blade portion facing away from the skin, at least at the cutting edge. An exemplary blade set 20 for the hair cutting appliance 10 may comprise an overall height or thickness in the range of about 0.3 mm to about 0.75 mm. The height or thickness of the skin-facing portion of the stationary blade, at least at the at least one leading edge, may be in the range of about 0.04 mm to about 0.25 mm. The height or thickness of the stationary blade portion facing away from the skin may be in the range of about 0.08 mm to about 0.4 mm. The height thickness of the movable blade 24, at least at the least one leading edge, may be in the range of about 0.05 mm to about 0.5 mm. The height of the movable blade 24 may basically correspond to a height of the guiding slot defined by the stationary blade 22 for the movable blade 24.

Figure 2:
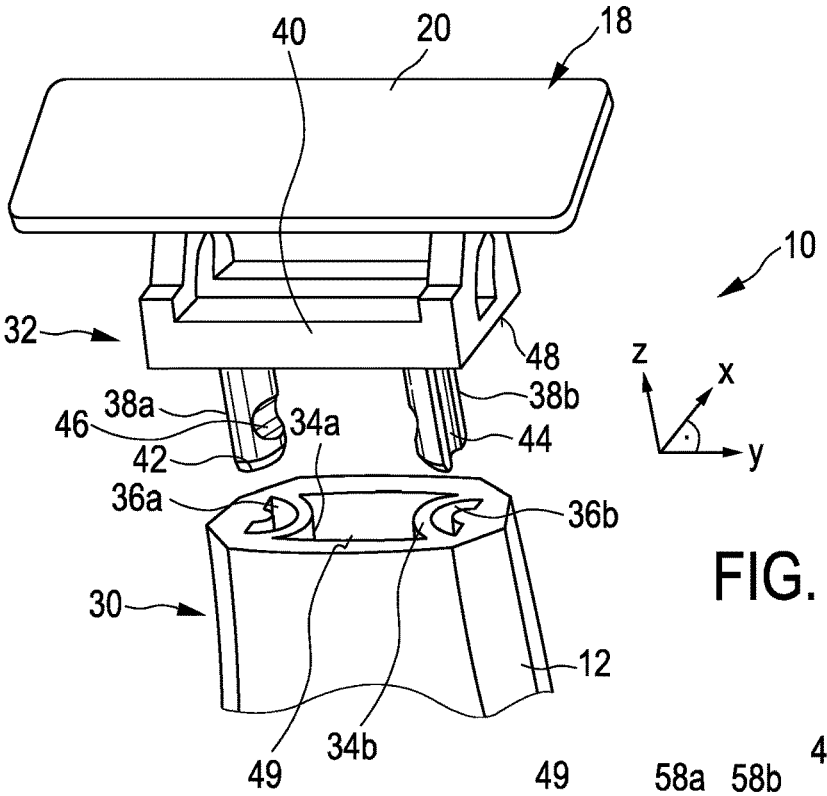
FIG. 2 shows a partial perspective view of a hair cutting appliance comprising a receiving receptacle and a cutting unit comprising a connector plug, shown in exploded view.
Figure 3:
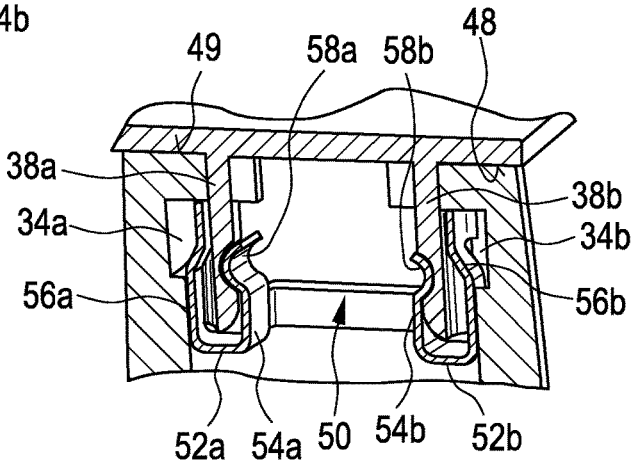
FIG. 3 shows a perspective partial cross-sectional view of the connector plug and receiving receptacle arrangement shown in FIG. 2.
Figure 4:
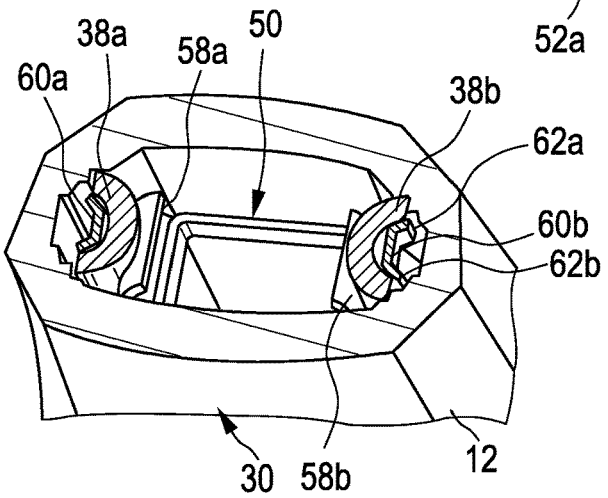
FIG. 4 shows a further, differently oriented, partial perspective cross-sectional view of the arrangement shown in FIG. 2.

With particular reference to FIGS. 2 to 4, an exemplary embodiment of a hair cutting appliance 10 including a releasable interface for the cutting unit 18 is illustrated and further detailed. The cutting unit 18 may be attached to and detached from the housing 12 of the hair cutting appliance 10 in an insertion direction that is basically parallel to the Z axis. The releasable interface may basically involve a receiving receptacle 30 and a corresponding connector plug 32. By way of example, with particular reference to FIG. 2, the receiving receptacle 30 may be arranged at the housing 12 of the hair cutting appliance 10. Consequently, the connector plug 32 may be provided at the cutting unit 18. It goes without saying that the respective mating components may be interchanged in some embodiments.

The receiving receptacle 30 includes at least one receiving socket 34*a*, 34*b*. For instance, the receiving receptacle 30 may include a first receiving socket 34*a* at a first lateral end thereof and a second receiving socket 34*b* at a second lateral end thereof. The at least one receiving socket 34*a*, 34*b* may comprise a respective receiving recess 36*a*, 36*b*. The receiving recess 36*a*, 36*b* may also be regarded as receiving opening, receiving aperture, etc. It is particularly preferred that the at least one receiving recess 36*a*, 36*b* defines an opening that basically corresponds to a cross-section of at least one corresponding engagement element 38*a*, 38*b* of the connector plug 32, when viewed in a plane that is basically parallel to the longitudinal direction X and the lateral direction Y. The connector plug 32 may comprise at least one engagement element 38*a*, 38*b* that may basically extend in the insertion direction Z from a base plate or base 40 thereof. In other words, the receiving receptacle 30 may comprise a hole pattern that is adapted to a pin or plug pattern at the connector plug 32. However, as will be further explained and illustrated below, it is not necessarily required to adapt the at least one receiving recess 36 and the at least one engagement element 38 in such a way that a tight fit therebetween is ensured. Accurate and free-of-play alignment of the connector plug 32 and the receiving receptacle is ensured by an interaction of the least one engagement element 38 and a biasing arrangement, as will be discussed further below.

The least one engagement element 38*a*, 38*b* may be provided with a tapered insertion portion 42 at a front end thereof. This may facilitate the insertion of the connector plug 32. The at least one engagement element 38*a*, 38*b* may be further provided with a contact indentation 44. As can be best seen in FIGS. 2 and FIG. 4, the contact indentation 44 may be formed as a concave or semicircular indentation 44 at a lateral side of the at least one engagement element 38*a*, 38*b*. Furthermore, the at least one engagement element 38*a*, 38*b* may be provided with a recess portion 46 at a lateral side thereof that is opposite to the lateral side where the contact indentation 44 is provided. The recess portion 46 primarily defines a contact surface that may be engaged for defining a vertical position of the connector plug 32. As already indicated above, the vertical position may basically correspond to the position in the insertion direction Z. The contact indentation 44 is primarily provided for aligning the connector plug 32 with respect to the receiving receptacle 30 in the longitudinal direction X. The receiving receptacle 30 and the connector plug 32 are shown in FIG. 2 in a detached state. FIG. 3 and FIG. 4 illustrate the receiving receptacle 30 and the connector plug 32 in an attached or mounted state. FIG. 3 illustrates a cross-sectional view wherein a cross-sectional plane is a central plane that is parallel to the insertion direction Z and the lateral direction Y. By contrast, FIG. 4 illustrates a cross-sectional view, wherein a cross-sectional plane is basically perpendicular to the insertion direction Z and parallel to the lateral direction Y.

As can be best seen in FIG. 3, the receiving receptacle 30 may further comprise a biasing arrangement 50 that includes at least one biasing unit 52*a*, 52*b*. Given the exemplary embodiment of the connector plug 32 introduced in FIG. 2, the biasing arrangement 50 comprises a first biasing unit 52*a*, that cooperates with the first engagement element 38*a*, and a second biasing unit 52*b* that cooperates with a second engagement element 38*b*. The biasing arrangement 50 is adapted to engage the at least one engagement element 38*a*, 38*b* of the connector plug 32. As used herein, engagement may particularly involve the exertion of biasing forces to the contact indentation 44 and the recess portion 46 of the least one engagement element 38. The biasing arrangement 50 may be arranged to define a receiving position for the connector plug 32 in the receiving direction Z, the lateral direction Y, and the longitudinal direction X.

The at least one biasing unit 52*a*, 52*b* may comprise a first biasing element 54*a*, 54*b*. The at least one first biasing element 54*a*, 54*b* may be configured to engage the respective recess portion 46 of the engagement element 38*a*, 38*b*. In this way a retaining force may be exerted to the engagement element 38*a*, 38*b* that has to be surmounted for releasing the cutting unit 18. It may be particularly preferred in some embodiments that the first biasing element 54 is provided with a respective projecting contact portion or bent contact portion 58*a*, 58*b*. It is further preferred that the first biasing element 54*a*, 54*b* and the respective contact portion 58 is configured to pull the engagement element 38*a*, 38*b* and, consequently, the base 40 of the connector plug 32 into a defined end position along the insertion direction Z, wherein an abutment surface 48 of the connector plug 32 contacts a corresponding abutment end 49 at the receiving receptacle 30. It is further preferred that the first biasing element 54*a*, 54*b* still exerts a pull force to the connector plug 32 in the end position. In this way, a basically free-of-play vertical alignment of the connector plug 32 and the receiving receptacle 30 may be achieved.

The at least one biasing unit 52*a*, 52*b* may further comprise a respective second biasing element 56*a*, 56*b* that is adapted to engage the contact indentation 44 at the engagement element 38*a*, 38*b*. As can be best seen in FIG. 4, the second biasing element 56*a*, 56*b* may be provided with an alignment contact portion 60*a*, 60*b* that may enter the respective contact indentation 44*a*, 44*b*. Particularly, the alignment contact portion 60*a*, 60*b* may be provided with opposing contact sections 62*a*, 62*b* that are provided at longitudinal ends of the alignment contact portions 60*a*, 60*b*. The opposing contact sections 62*a*, 62*b* may be arranged opposite to each other. The opposing contact sections 62 may engage an (inner) concave surface of the contact indentation 44. In this way, the longitudinal position of the engagement element 38*a*, 38*b* and, consequently, the connector plug 32, can be defined and aligned.

It is particularly preferred that the first biasing element 54 and the second biasing element 56 of a respective biasing unit 52*a*, 52*b* are adapted to bias the respective engagement element 38*a*, 38*b* in opposite directions. Consequently, also the lateral position of the engagement element 38*a*, 38*b* and the connector plug 32 can be defined.

As can be best seen from FIGS. 3 and 4, the biasing arrangement 50 may comprise an integrated single-piece structure including the first biasing unit 52*a* and the second biasing unit 52*b*, each of which including a respective first biasing element 54*a*, 54*b* and a respective second biasing element 56*a*, 56*b*. Consequently, the connector plug 32 comprising two engagement elements 38*a*, 38*b* can be centered and reliably secured at the receiving receptacle 30. The biasing arrangement 50 may be formed as an integral flat spring arrangement. As can be best seen in FIG. 4, the biasing arrangement 50 is, in a preferred embodiment, shaped such that a space or clearance is provided at a center portion of the housing 12. Consequently, the biasing arrangement 50 does not obstruct the space required for the drive mechanism 16 (refer also to FIG. 1).

The detachable interface illustrated in FIGS. 2 to 4 is a basically self-locking interface. When inserting the cutting unit 18 comprising the connector plug 32 into the receiving receptacle 30, the user may exert an insertion force to the cutting unit 18 for engaging the contact indentations 44 and, primarily, the recess portions 46 at the engagement elements 38*a*, 38*b*. At a certain position along the insertion direction Z, the first biasing elements 54*a*, 54*b* may snap in and engage the recess portions 46 with their bent contact portions 58*a*, 58*b*. The user is not necessarily required to align the cutting unit 18 at the receiving receptacle 30. The detachable interface can be formed in a self-aligning manner.

For releasing the cutting unit 18 from the receiving receptacle 30, the user basically has to exert a release force that is sufficiently high to disengage the contact portions 58*a*, 58*b* from the recess portions 46 at the engagement elements 38*a*, 38*b*. It is not required to release an additional lock element.

Figure 5:
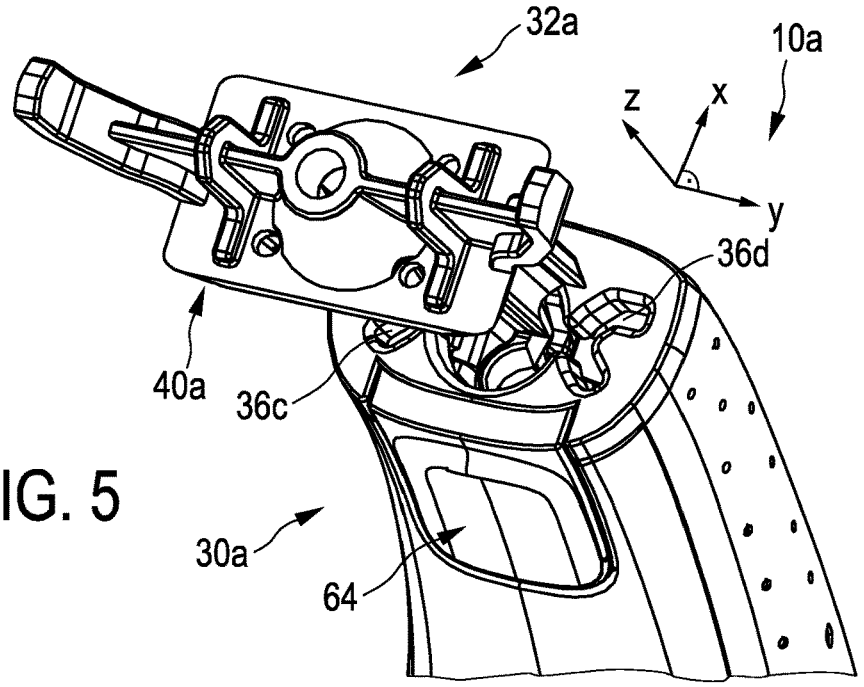
FIG. 5 shows a partial perspective view of another embodiment of a hair cutting appliance having a receiving receptacle and a connector plug, the connector plug shown in a released state.
Figure 6:
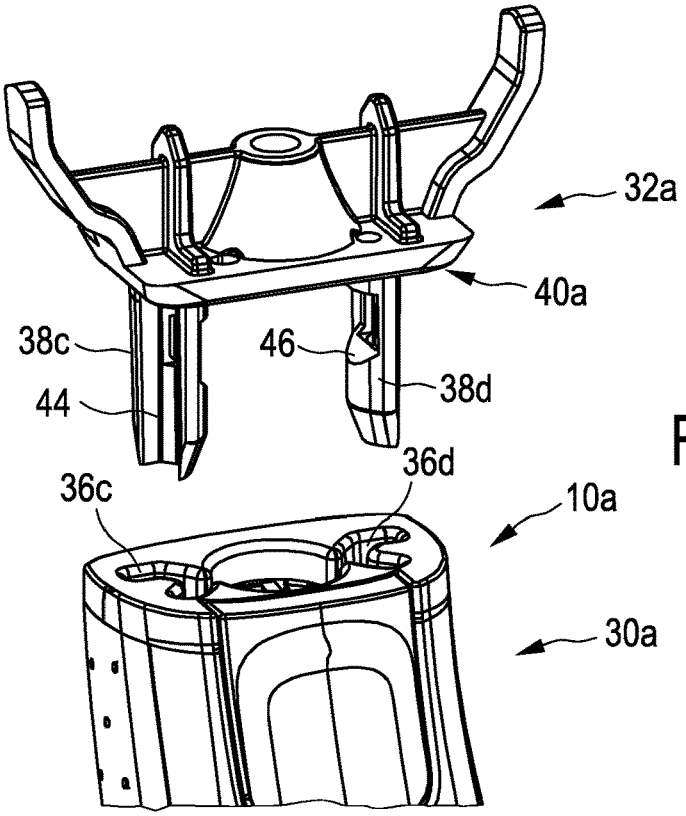
FIG. 6 shows another perspective view of the arrangement shown in FIG. 5.

With particular reference to FIGS. 5 and 6, an alternative embodiment of a hair cutting appliance 10 will be described and further detailed. The hair cutting appliance 10*a* comprises a detachable interface including a receiving receptacle 30*a* and a corresponding connector plug 32*a*. The connector plug 32*a* is integrally formed as an injection molded part. The connector plug 32*a* includes a base portion 40*a* comprising a first engagement element 38*c* and a second engagement element 38*d* extending in the insertion direction Z therefrom. At the receiving receptacle 30*a*, two respective receiving recesses 36*c*, 36*d* are provided, that are adapted to a cross-sectional shape of the engagement elements 38*c*, 38*d*. As can be best seen in FIG. 5, the receiving recesses 36*c*, 36*d* and, correspondingly, the engagement elements 38*c*, 38*d*, may comprise a shape that is not mirror-symmetric with respect to the central plane defined by the insertion direction Z and the lateral direction Y. However, the receiving recesses 36*c*, 36*d* and the engagement elements 38*c*, 38*d* can be mirror-symmetric with respect to a transverse plane that is defined by the insertion direction Z and the longitudinal direction X. This embodiment may prevent assembly failures. FIG. 5 further illustrates a slide element 64 that may facilitate disengaging the connector plug 32*a* through a pushing action. The slide element 64 may be pushed against the base portion 40*a* in the Z direction and, consequently, release the first engagement element 38*c* and the second engagement element 38*d* from the receiving biasing element 50, refer also to FIG. 3 in this regard.

Figure 7:
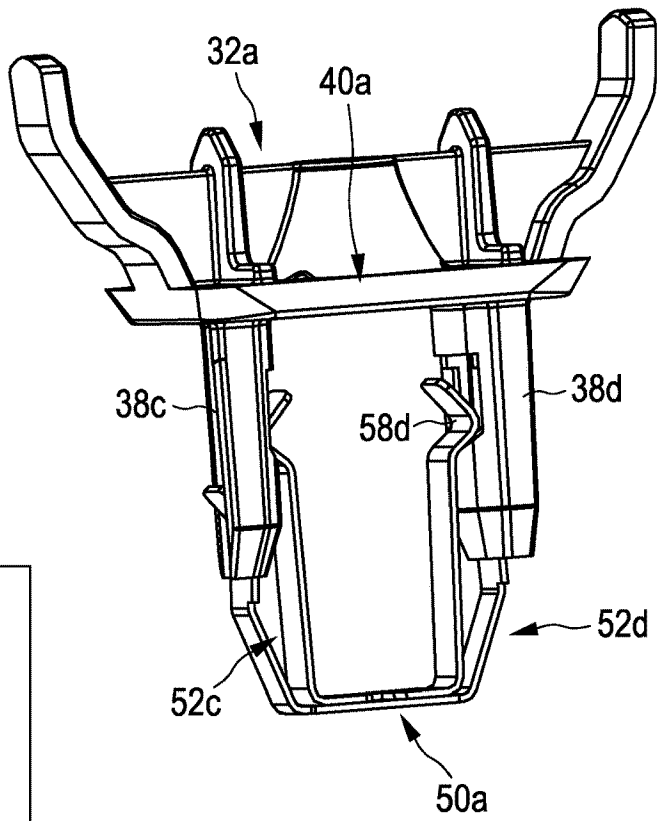
FIG. 7 shows a detailed perspective view of the connector plug shown in FIGS. 5 and 6, the connector plug cooperating with a first biasing unit and a second biasing unit.
Figure 8:
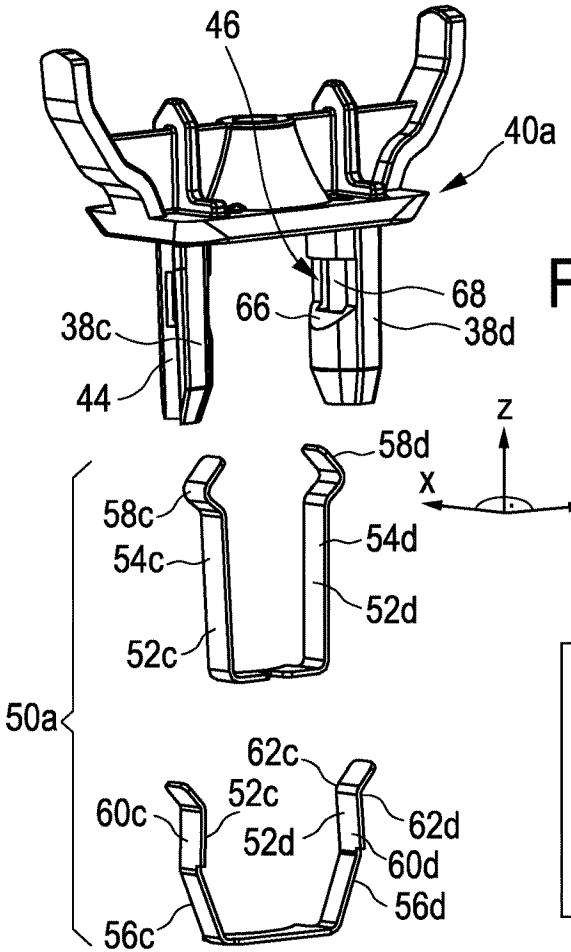
FIG. 8 shows a further detailed perspective view of the arrangement shown in FIG. 7 in an exploded state.
Figure 9:
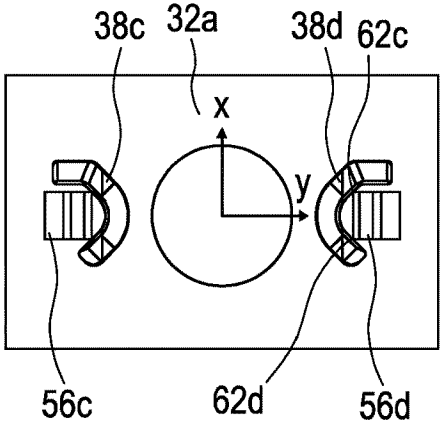
FIG. 9 shows a simplified schematic bottom view of the connector plug shown in FIG. 7, the connector plug cooperating with respective second biasing elements.

The connector plug 32*a* and its respective engagement elements 38*c*, 38*d* are further described and illustrated in connection with respective biasing arrangements 50*a*, 50*b* in FIGS. 7 to 11. An exemplary flat spring biasing arrangement 50*a* is illustrated in FIGS. 7 and 8. An exemplary biasing arrangement 50*b* including a flat spring and a wire spring is illustrated in FIG. 10 and FIG. 11.

With reference to FIG. 7, the biasing arrangement 50*a* is described. By way of example, the biasing arrangement 50*a* can be composed of two flat springs. The two flat springs may be basically U-shaped or V-shaped. As can be best seen with further reference to FIG. 8, the two flat springs may be combined such that they commonly form a first biasing unit 52*c* composed of a first biasing element 54*c* and a second biasing element 56*c*, and a second biasing unit 52*d* composed of a first biasing unit 54*d* and a second biasing element 56*d*. The second biasing elements 56*c*, 56*d* may be configured to engage the basically vertically extending contact indentations 44 at the engagement elements 38*c*, 38*d*. Further reference in this regard is made to FIG. 9. For engaging the contact indentations 44, the second biasing elements 56*c*, 56*d* may be provided with respective contact portions 60*c*, 60*d*. Each of the contact portions 60*c*, 60*d* may be further provided with opposing contact sections 62*c*, 62*d*. It can be further seen from FIG. 9 that the opposing contact sections 62*c*, 62*d* may be formed by longitudinal edges of the contact portions 60*c*, 60*d*. The second biasing elements 56*c*, 56*d* can be further configured to act towards each other, thereby defining the lateral position and the longitudinal position of the connector plug 32*a*. This can be achieved since the opposing contact sections 62*c*, 62*d* may cooperate with inclined or curved surfaces of the contact indentations 44 of the engagement elements 38*c*, 38*d* that are basically oblique with respect to the longitudinal direction X and to the lateral direction Y. By way of example, the inclined contact surfaces at the engagement elements 38*c*, 38*d* may be arranged at an angle of about 45° with respect to the longitudinal direction X and the lateral direction Y. Consequently, a biasing force generated by the biasing elements 56*c*, 56*d* that is basically perpendicular to the longitudinal direction X can be "decomposed". Consequently, resulting longitudinal components and lateral components may be generated that may contribute to aligning and positioning the connector plug 32*a* in the longitudinal direction X and the lateral direction Y.

With particular reference to FIG. 8, a further embodiment of the recess portion 46 at the engagement elements 38*c*, 38*d* is described. The recess portion 46 may involve a tapered surface 66 that is inclined with respect to the insertion direction Z. Furthermore, the recess portion 46 may comprise a lateral aperture 68 in the engagement element 38*c*, 38*d*.

Figure 10:
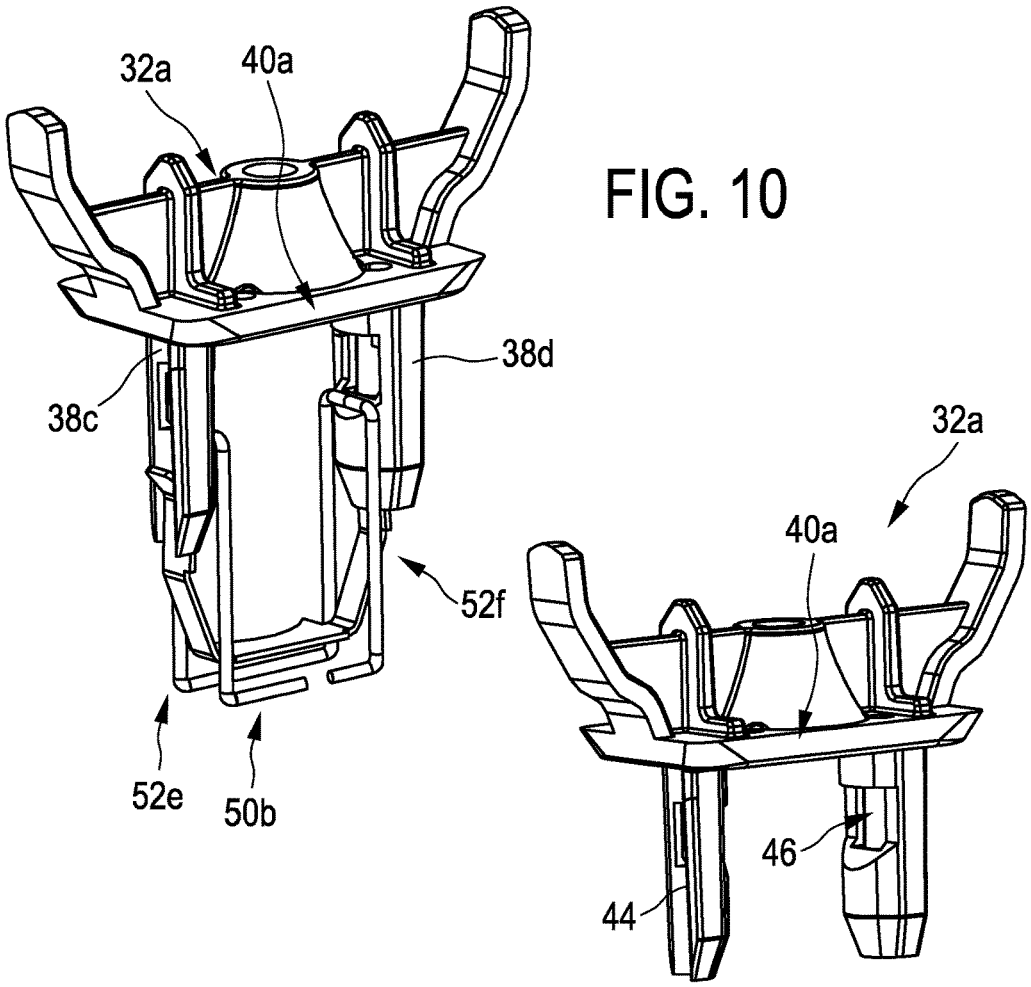
FIG. 10 illustrates another detailed perspective view of yet another embodiment comprising the connector plug shown in FIG. 7 and an alternative spring unit arrangement.
Figure 11:
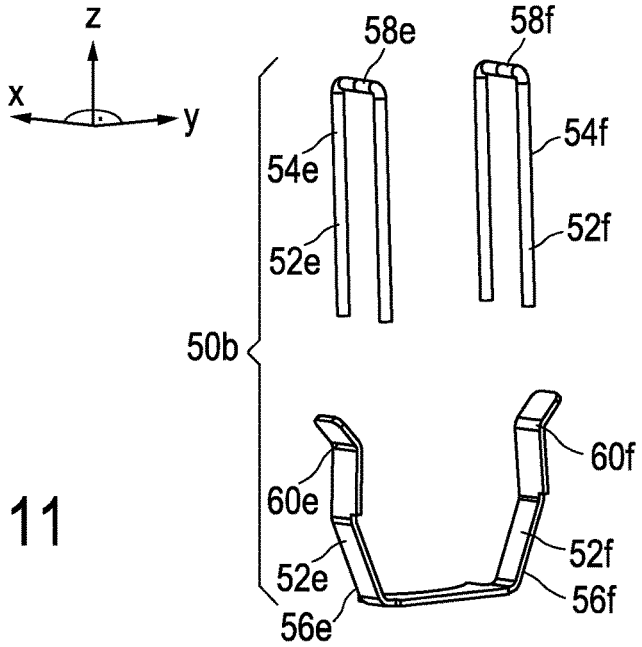
FIG. 11 shows another perspective view of the connector plug and the biasing unit shown in FIG. 10 in an exploded state.

FIGS. 10 and 11 further illustrate an alternative embodiment of the biasing arrangement 50. The biasing arrangement 50*b* shown in FIG. 10 is composed of a flat spring and a wire spring. The wire spring may be formed as an integral wire spring comprising the first biasing element 54*e* of the first biasing unit 52*e* and the first biasing element 54*f* of the second biasing unit 52*f*. The first biasing elements 54*e*, 54*f* may be integrally formed, refer to FIG. 10. However, alternatively, the first biasing elements 54*e*, 54*f* may also be formed as separate biasing elements, refer to FIG. 11. Each of the first biasing elements 54*e*, 54*f* may comprise two substantially vertically extending arms, wherein the arms are respectively connected by a contact portion 58*e*, 58*f* that is configured to contact the recess portion 46 of the engagement element 38*c*, 38*d*. The wire-spring-based first biasing elements 54*e*, 54*f* may cooperate with flat-spring-based second biasing elements 56*e*, 56*f*. The biasing elements 54*e*, 56*e* may form a first biasing unit 52*e*. The biasing elements 54*f*, 56*f* may form the second biasing unit 52*f*. The biasing elements 56*e*, 56*f* may be provided with respective contact portions 60*e*, 60*f* for engaging the contact indentations 44 at the engagement elements 38*c*, 38*d*.

It is again emphasized in this connection that the biasing arrangements 50, 50*a*, 50*b* in accordance with the principles of the present disclosure may be differently shaped and structured. For instance, each biasing unit 52 may be formed as a separate biasing unit. Consequently, the first biasing element 54 and the second biasing element 56 of a respective biasing unit may be integrally formed. Furthermore, each of the first and second biasing elements 54, 56 may be formed as a separate part. The biasing elements 54, 56 may be formed as metal biasing elements but also as plastic biasing elements. The biasing elements 54, 56 may be shaped as leaf springs or flat springs, but also as wire springs or coil springs. It is further envisaged that at least one of the biasing elements 54, 56, preferably, the biasing arrangement 50 is provided at the receiving receptacle 30 as a snap-in or an insert-molding part.

In accordance with the principles of the present disclosure, biasing forces of the biasing elements 54, 56 that are basically exerted in a direction perpendicular to the longitudinal direction and, more preferably, also at least substantially perpendicular to the insertion direction Z can be suitably decomposed such that resulting force components align the connector plug 32, 32*a* spatially, i.e. in the longitudinal direction X, in the lateral direction Y and in the insertion direction Z.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the stationary blade, the blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A receiving receptacle for a connector plug for connecting a detachable cutting unit of a hair cutting appliance, the receiving receptacle comprising:

at least one receiving socket having a receiving recess that is configured to receive a respective engagement element of the connector plug; and at least one biasing unit arranged in the at least one receiving socket , wherein the at least one biasing unit comprises a first biasing element and a second biasing element opposing the first biasing element, the first biasing element and the second biasing element being spaced with respect to each other, the first biasing element and the second biasing element being arranged on opposite sides of the engagement element of the connector plug for receiving the engagement element at a receiving position in a biasing manner, wherein the first biasing element and the second biasing element have different shapes, wherein the first biasing element comprises a retaining contact portion that is configured to define the receiving position of the engagement element in an insertion direction (Z), and wherein the second biasing element comprises an alignment contact portion that is configured to define the receiving position of the engagement element in a longitudinal direction (X) and in a lateral direction (Y).

2. The receiving receptacle of claim 1, wherein the at least one biasing unit comprises at least one flat spring element.

3. The receiving receptacle of claim 1, wherein the at least one biasing unit comprises at least one wire spring element.

4. The receiving receptacle of claim 1, wherein the retaining contact portion of the first biasing element comprises a bent section that is adapted to engage the engagement element, thereby defining the receiving position of the engagement element in the insertion direction (Z).

5. The receiving receptacle of claim 1, wherein the alignment contact portion of the second biasing element comprises opposite contact sections arranged at longitudinal ends thereof that define the receiving position of the engagement element in the longitudinal direction (X).

6. The receiving receptacle of claim 1, wherein the first biasing element is arranged to urge the engagement element in the lateral direction (Y), wherein the second biasing element is arranged to urge the engagement element in the lateral direction (Y), wherein the first biasing element and the second biasing element are urging towards each other, thereby defining the receiving position of the engagement element in the lateral direction (Y).

7. The receiving receptacle of claim 1, comprising a first receiving recess and a second receiving recess that are adapted to receive a first engagement element and a second engagement element, the first receiving recess and the second receiving recess being laterally spaced with respect to each other, and a first biasing unit and a second biasing unit respectively arranged in a first receiving socket and a second receiving socket underneath the first receiving recess and the second receiving recess.

8. The receiving receptacle of claim 7, wherein the respective first biasing elements of the first biasing unit and the second biasing unit are integrally formed.

9. The receiving receptacle of claim 1, wherein the at least one biasing unit has a u-shape, and wherein the first biasing element and the second biasing element are legs of the u-shape and are connected at a base to form the u-shape.

10. The receiving receptacle of claim 1, wherein the alignment contact portion has contact sections at longitudinal ends of the alignment contact portion, wherein the contact sections are configured to contact a portion of a surface of the engagement element, and wherein the contact sections are connected by an intermediate portion that is configured to be spaced away from the engagement element.

11. The receiving receptacle of claim 1, wherein the alignment contact portion has contact sections at longitudinal ends of the alignment contact portion, and wherein the contact sections are configured to contact a portion of a concave surface of the engagement element.

12. The receiving receptacle of claim 1, wherein the first biasing element has a portion curved towards the engagement element for engaging a recess portion of the engagement element, and wherein the second biasing element has contact sections configured to contact a portion of a surface of the engagement element leaving other portions of the surface of the engagement element free from contact.

13. A hair cutting appliance having a housing accommodating a motor and including a receiving receptacle, and a detachable cutting unit having a connector plug for connecting the detachable cutting unit to the receiving receptacle of the housing, the receiving receptacle comprising:

at least one receiving socket having a receiving recess that is configured to receive a respective engagement element of the connector plug; and at least one biasing unit arranged in the at least one receiving socket, wherein the at least one biasing unit comprises a first biasing element and a second biasing element opposing the first biasing element, the first biasing element and the second biasing element being spaced with respect to each other, the first biasing element and the second biasing element being arranged on opposite sides of the engagement element of the connector plug for receiving the engagement element at a receiving position in a biasing manner, wherein the first biasing element and the second biasing element have different shapes.

14. The hair cutting appliance of claim 13, wherein the first biasing element comprises a retaining contact portion that is configured to define the receiving position of the engagement element in an insertion direction (Z), and wherein the second biasing element comprises an alignment contact portion that is configured to define the receiving position of the engagement element in a longitudinal direction (X) and in a lateral direction (Y).

15. The hair cutting appliance of claim 13, wherein the engagement element of the connector plug extends from a base in an insertion direction (Z) and has, viewed in a plane perpendicular to the insertion direction (Z), a cross-sectional profile configured to fit through the receiving recess of the at least one receiving socket, wherein the engagement element comprises a contact indentation extending substantially parallel to the insertion direction (Z), wherein the contact indentation is configured to contact the at least one biasing unit of the receiving receptacle to define the receiving position of the engagement element in a longitudinal direction (X), wherein the engagement element comprises an engagement recess portion that is configured to contact the at least one biasing unit of the receiving receptacle to define the receiving position of the engagement element in the insertion direction (Z), and wherein the contact indentation and the engagement recess portion are arranged on opposite sides of the engagement element.

16. A receiving receptacle for a connector plug for connecting a detachable cutting unit of a hair cutting appliance, the receiving receptacle comprising:

at least one receiving socket having a receiving recess that is configured to receive a respective engagement element of the connector plug; and at least one biasing unit arranged in the at least one receiving socket, wherein the at least one biasing unit comprises a first biasing element and a second biasing element opposing the first biasing element, the first biasing element and the second biasing element being spaced with respect to each other, the first biasing element and the second biasing element being arranged on opposite sides of the engagement element of the connector plug for receiving the engagement element at a receiving position in a biasing manner, wherein the first biasing element and the second biasing element have different shapes.

17. The receiving receptacle of claim 16, wherein the first biasing element comprises a retaining contact portion that is configured to define the receiving position of the engagement element in an insertion direction (Z), and wherein the second biasing element comprises an alignment contact portion that is configured to define the receiving position of the engagement element in a longitudinal direction (X) and in a lateral direction (Y).

18. The receiving receptacle of claim 17, wherein the first biasing element and the second biasing element have the different shapes along the lateral direction (Y).

19. The receiving receptacle of claim 16, wherein the second biasing element comprises alignment contact portions and a non-contact portion, wherein the alignment contact portions are configured to contact a portion of a surface of the engagement element, and wherein the non-contact portion is between the alignment contact portions and is configured to not contact the engagement element of the connector plug.

20. The receiving receptacle of claim 16, wherein the first biasing element has a portion curved towards the engagement element for engaging a recess portion of the engagement element, and wherein the second biasing element has contact sections configured to contact a portion of a surface of the engagement element leaving other portions of the surface of the engagement element free from contact.

* * * * *